US007488162B2

(12) United States Patent
Jordan

(10) Patent No.: US 7,488,162 B2
(45) Date of Patent: Feb. 10, 2009

(54) HYDRAULIC PUMP FOR A POWER STEERING SYSTEM

(75) Inventor: Martin Jordan, Duesseldorf (DE)

(73) Assignee: TRW Automotive GmbH (DE)

( * ) Notice: Subject to any disclaimer, the term of this patent is extended or adjusted under 35 U.S.C. 154(b) by 0 days.

(21) Appl. No.: 11/205,788

(22) Filed: Aug. 17, 2005

(65) Prior Publication Data

US 2006/0051230 A1 Mar. 9, 2006

Related U.S. Application Data

(63) Continuation of application No. PCT/EP2004/001489, filed on Feb. 17, 2004.

(30) Foreign Application Priority Data

Feb. 17, 2003 (DE) ..... 203 02 535 U

(51) Int. Cl.
*F03C 2/00* (2006.01)
*F04C 15/00* (2006.01)

(52) U.S. Cl. ..... 418/132; 418/15; 418/181; 418/206.1; 417/310

(58) Field of Classification Search ..... 418/132–135, 418/206.1–206.5, 181, 201.1, 166, 171, 15; 417/310, 313, 410.4, 366, 440, 410.1
See application file for complete search history.

(56) References Cited

U.S. PATENT DOCUMENTS

| | | | | |
|---|---|---|---|---|
| 2,809,592 | A * | 10/1957 | Miller et al. | 418/132 |
| 3,263,425 | A * | 8/1966 | Rohde | 418/206.1 |
| 3,859,014 | A | 1/1975 | Dworak et al. | |
| 4,505,655 | A | 3/1985 | Honaga et al. | |
| 4,830,592 | A | 5/1989 | Weidhaas | |
| 6,158,983 | A * | 12/2000 | Harpole et al. | 418/181 |
| 6,227,816 | B1 * | 5/2001 | Breuer et al. | 418/132 |
| 6,322,329 | B1 * | 11/2001 | Vera | 418/206.1 |

FOREIGN PATENT DOCUMENTS

| | | |
|---|---|---|
| DE | 1 528 954 | 7/1970 |
| DE | 2 136 214 | 2/1973 |
| EP | 0 287 698 | 10/1988 |
| EP | 0 987 439 | 3/2000 |
| GB | 1 212 101 | 7/1968 |
| JP | 2000-283044 | 10/2000 |
| JP | 2001-003872 | 1/2001 |

* cited by examiner

*Primary Examiner*—Theresa Trieu
(74) *Attorney, Agent, or Firm*—MacMillan, Sobanski & Todd, LLC

(57) ABSTRACT

A pump, in particular a hydraulic pump for a power steering system, has a housing. The pump is a prefabricated structural unit in which the end faces of the housing are closed by a flange and by a cover, respectively. The flange and the cover are braced against each other by at least one holding part.

19 Claims, 3 Drawing Sheets

HYDRAULIC PUMP FOR A POWER STEERING SYSTEM

CROSS-REFERENCE TO RELATED APPLICATIONS

This application is a continuation of International Application No. PCT/EP2004/001489 filed Feb. 17, 2004, the disclosures of which are incorporated herein by reference, and which claimed priority to German Patent Application No. 203 02 535.0 filed Feb. 17, 2003, the disclosures of which are incorporated herein by reference.

BACKGROUND OF THE INVENTION

The invention relates to a pump, in particular a hydraulic pump for a power steering system, comprising a housing.

Such pumps are generally assembled from many individual parts, so that they are very costly to put together. The installation of the pump, for example into a motor/pump unit of a power steering device of a motor vehicle, generally takes place in a complicated way by means of screws or similar connecting means. In addition, the individual components of the pump are to be designed taking into account the pressure difference between the interior and exterior of the pump.

The need therefore exists for a simply and compactly constructed pump, which is possible to put together and install into a motor/pump unit or the like at a favorable cost and without effort.

BRIEF SUMMARY OF THE INVENTION

According to the invention, in a pump of the type initially mentioned, provision is made that the pump is a prefabricated structural unit in which the end faces of the housing are closed by a flange and by a cover, respectively, the flange and the cover being braced against each other by at least one holding part. The invention is based on the finding that a pump according to the invention can be housed in a fluid-filled space which is acted upon with pressure either by the pump itself or by some other means. In designing the individual parts of the pump, it can therefore be assumed that the pressure promotes the holding together of the individual parts with each other and also the fixing of the pump as a structural unit. Under this precondition, only a low pressing force of the individual parts is required for ensuring the start-up of the pump. This pressing force is necessary for sealing the suction and pressure zones of the pump. Owing to the external action on the housing, the flange and the cover of the pump, only a small or even no force difference exists between the interior of the pump and the space surrounding the pump, so that the wall thicknesses of the aforementioned components of the pump can be minimized. The construction of the pump as a prefabricated structural unit has, in addition, the advantage that each pump can be tested before delivery or before being installed, and that the installation as a structural unit is substantially simplified compared with the installation of numerous separate individual parts. In addition, in the putting together of a pump designed according to the invention, it is not necessary to connect the flange and the cover individually with the housing. The holding part makes provision that both the flange and also the cover are pressed against the housing, without further fixing means being required for this.

According to an embodiment of the invention, several holding parts are provided in the form of screws, which extend from the cover to the flange. This embodiment has the advantage that conventional, favorably priced components can be used.

According to another embodiment, the holding part is a bracket-shaped spring element. The use of such a spring element has the advantage that during assembly, no risk of contamination exists as with a screw connection. In this embodiment, the height of the flange and of the cover can be designed so be small, because no thread has to be formed and no screw head has to be received.

Preferably, the spring element has a central section held in a recess of the cover or of the flange, and two sections engaging behind the flange or the cover. Such a spring element is simple to produce and easy to install. According to a further development of the invention, the spring element has a corrugated section which can provide for a bracing of the pump between two opposite components, e.g. between a resonator base and a resonator cover of a motor/pump unit.

For use in a motor/pump unit, in particular a pump according to the invention is suitable in which in the housing a gear wheel set with two mating gear wheels is housed, which are arranged on two shafts or are constructed in one piece with the shafts, the shafts being mounted in two opposite bearing rests and one of the shafts extending out of the end face of the housing.

Other advantages of this invention will become apparent to those skilled in the art from the following detailed description of the preferred embodiments, when read in light of the accompanying drawings.

DETAILED DESCRIPTION OF THE INVENTION

Figure 1:
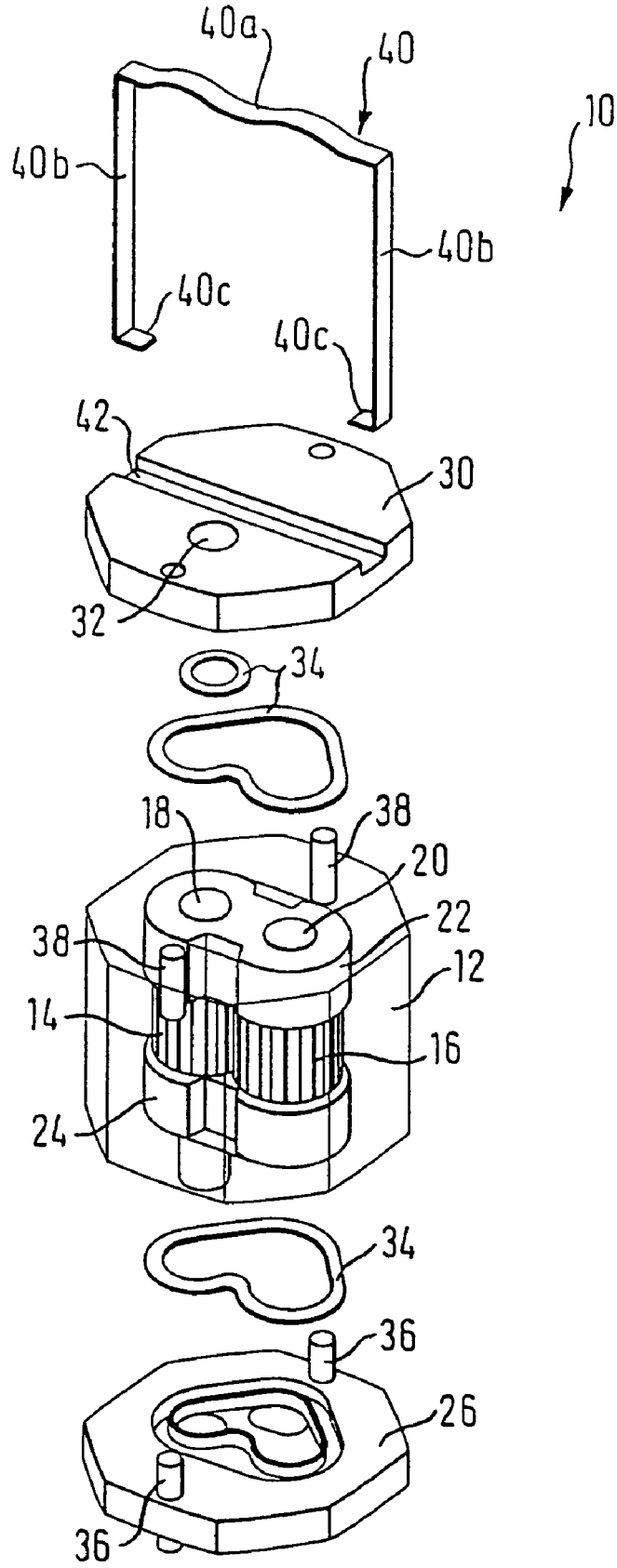
FIG. 1 shows an exploded view of a pump according to the invention in accordance with a first embodiment.
Figure 2A:
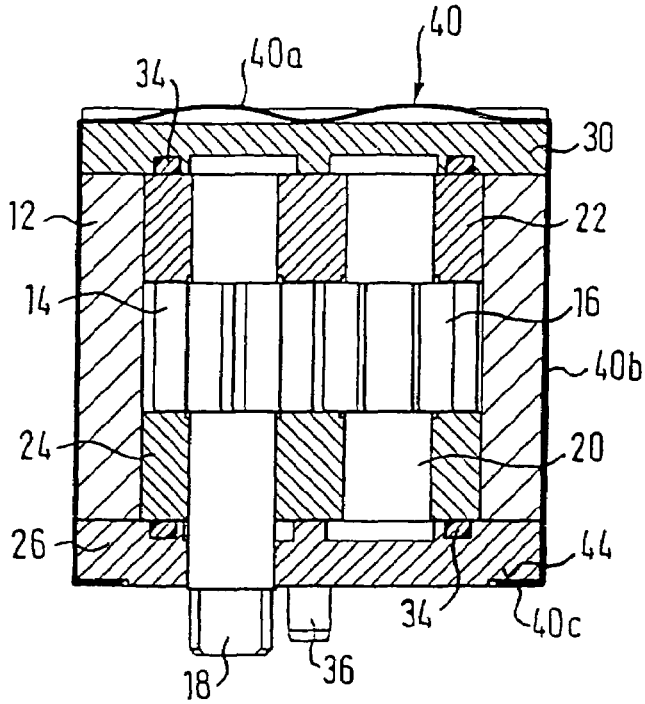
FIGS. 2*a* and 2*b* show sectional views of the pump of FIG. 1 from different sides.
Figure 2B:
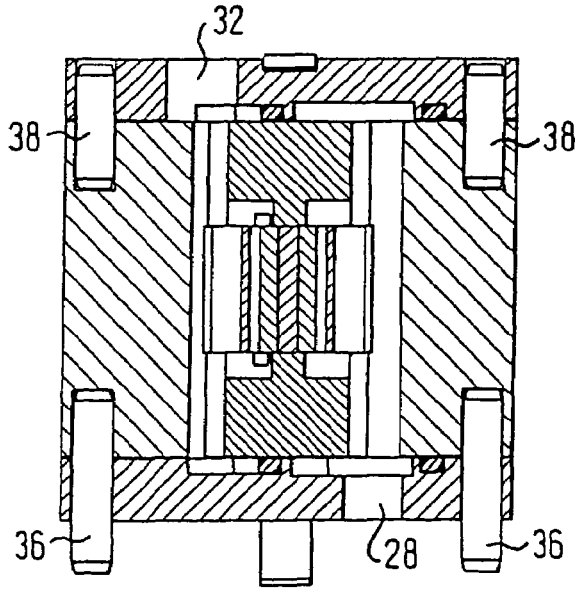

The pump 10 shown in FIGS. 1 and 2 is a so-called external gear pump having a housing 12 similar to a cylinder, which is illustrated transparent in FIG. 1, in order to make the components visible which are situated therein. In the housing 12 a gear wheel set with two mating gear wheels 14, 16 is housed, which are each constructed in one piece with a shaft 18 or respectively 20. The shafts 18, 20 are mounted in two opposite bearing rests 22, 24, with one of the shafts, the drive shaft 18, extending out of the housing 12 at an end face. This side of the housing 12 is closed off by a flange 26, which has an opening for the drive shaft 18 and a suction connection 28. The opposite end face of the housing 12 is closed by a cover 30 in which a pressure connection 32 is formed. The flange 26 and the cover 30 can be punched, sintered or aluminum diecast parts. Sealing elements 34 are inserted between the housing 12 and both the flange 26 and the cover 30. For the correct positioning of the flange 26 and of the cover 30, centering pins 36 and 38 are provided on the flange 26 and on the housing 12, respectively, which engage into corresponding recesses in the housing 12 and in the cover 30, respectively. The centering pins 36 of the flange 26 extend on both sides of the flange 26.

In the embodiment of the pump 10 according to the invention, shown in FIGS. 1 and 2, the components of the pump 10, in particular the housing 12, the flange 26 and the cover 30, are held together by a holding part in the form of a specially shaped spring element 40. The elastically deformable spring element 40 is constructed in the manner of a bracket with a central corrugated section 40*a*, at the ends of which two side sections 40*b* adjoin which are bent away at right-angles, from which in turn two short holding sections 40*c* extend at right-angles. The corrugated section 40*a* is held in a recess 42 of the cover 30, in order to prevent a lateral slipping of the spring element 40. The two side sections 40*b* lie against the peripheral wall of the housing 12, and the two holding sections 40*c* engage behind the flange 26, which has two fitting recesses 44 for the holding sections 40*c*. However, it is also possible that the spring element 40 is arranged the other way round. In this case, the recesses in the cover 30 and in the flange 26 are exchanged.

In addition to fixing the individual pump components in place, the centering of the cover 30 and/or of the flange 26 relative to the housing 12 can be effected solely by the spring element 40. In this case, the centering pins 36, 38 and the corresponding recesses in the respective components can be eliminated, which is indicated symbolically in FIG. 2*b*.

Figure 3:
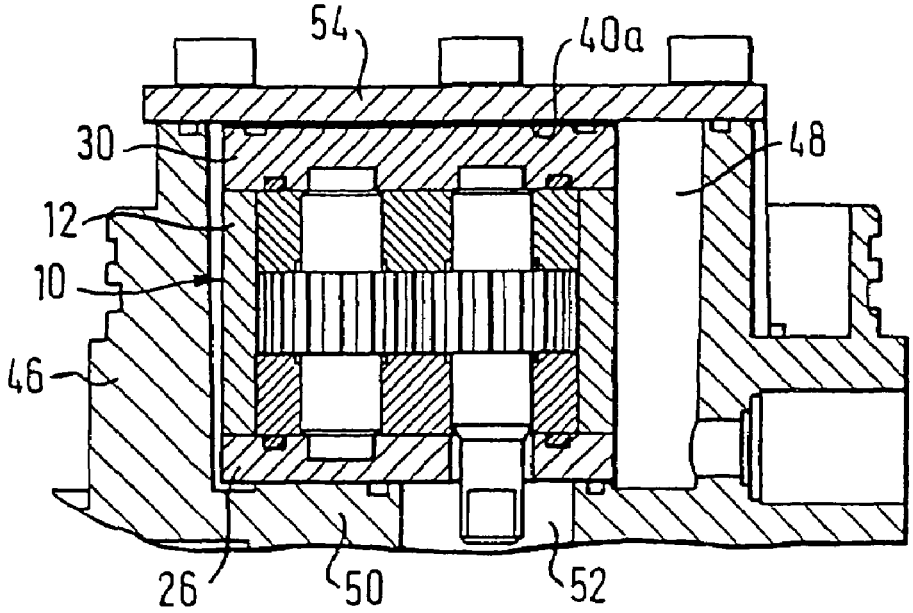
FIG. 3 shows a sectional view of the pump of FIG. 1 in the installed state.

FIG. 3 shows the pump 10 installed in a motor/pump unit which can be a component part of a power steering system of a motor vehicle. In a housing section 46 of the motor/pump unit, a resonator space 48 is formed, in which the pump 10 is inserted. The centering pins 36 provided on the flange 26 engage into corresponding recesses in the wall 50 of the housing section 46 lying against the flange 26. In this wall 50, an opening 52 to a motor chamber is provided, into which the drive shaft 18 extends, in order to make possible a coupling of the drive shaft 18 to the motor shaft of the drive motor (not shown). In addition, the opening 52 connects the suction connection 28 of the pump 10 with the motor chamber which serves as a hydraulic fluid reservoir. The resonator space 48 is closed by a resonator cover 54 which is screwed to the housing section 46, which cover 54 rests on the cover 30 of the pump 10. The corrugated section 40*a* of the spring element 40 presses the pump 10 against the wall 50 lying opposite the resonator cover 54 and therefore provides for a bracing of the pump 10 in the resonator space 48. The spring element 40 therefore serves for applying a sealing force for the suction and the pressure regions of the pump 10 in the resonator space 48 and also for the individual pump components: cover 30, housing 12 and flange 26. The resonator space 48 is in direct connection with the high pressure connection 32 of the pump 10, so that in operation of the pump 10 an external action on the pump 10 is present. The resulting pressure in the hydraulic fluid surrounding the pump 10 here supports the pressing force of the seals.

Figure 4:
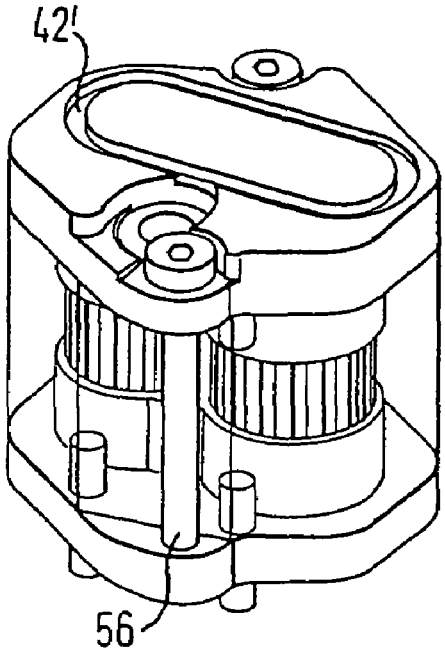
FIG. 4 shows a perspective view of a pump according to the invention in accordance with a second embodiment.

The structure of the embodiment shown in FIG. 4 corresponds substantially to the embodiment previously described. The centering and fixing of the pump components takes place here, however, not by means of a spring element but rather by means of screws 56, by which the flange 26 and the cover 30 are braced against each other. In order to make possible a bracing of the pump 10 in the installed state in a resonator space (see FIG. 3), an additional spring element (not shown), e.g. in the form of a spiral spring, is provided which is inserted in a recess 42' formed in the cover.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A motor/pump unit for a power steering system, comprising:

a motor/pump housing defining a resonator space, the resonator space being in communication with a high fluid pressure connection of the motor/pump unit, a prefabricated structural hydraulic gear pump unit including a pump housing having first and second end faces, and a flange and a pump cover closing the first and second end faces, respectively, the flange and the pump cover being braced against each other by at least one holding part, the prefabricated structural hydraulic gear pump unit disposed in the resonator space, and a resonator cover bracing the prefabricated structural hydraulic pump unit in the resonator space.

2. The motor/pump unit of claim 1 wherein the motor/pump housing includes a wall at least partially defining the resonator space and wherein the prefabricated structural hydraulic gear pump unit is braced in the resonator space between the resonator cover and the wall.

3. The motor/pump unit of claim 2 wherein one of the pump cover and the flange is braced against the wall and the other of the pump cover and the flange is braced against the resonator cover.

4. The motor/pump unit of claim 3 wherein the flange is braced against the wall and the pump cover is braced against the resonator cover.

5. The motor/pump unit of claim 1 wherein the pump housing, the pump cover and the flange are fixed together by the at least one holding part prior to installation of the prefabricated structural hydraulic gear pump unit in the resonator space.

6. The motor/pump unit of claim 1 wherein the prefabricated structural hydraulic gear pump unit is a preassembled unit relative to installation in the resonator space.

7. The motor/pump unit of claim 1 wherein the prefabricated structural hydraulic gear pump unit is suitable to be tested before being installed into the motor/pump housing.

8. The motor/pump unit of claim 1 wherein on the flange, centering pins are provided for positioning the prefabricated structural hydraulic gear pump unit within the resonator space and for positioning the flange with respect to the pump housing, the centering pins extending on both sides of the flange.

9. The motor/pump unit of claim 8, wherein the centering pins are provided for positioning the flange and the pump cover with respect to the pump housing.

10. The motor/pump unit of claim 8, wherein on the flange, the centering pins are provided for positioning the pump with respect to a component lying against the flange.

11. The motor/pump unit of claim 10, wherein the centering pins are also provided for positioning the flange with respect to the pump housing, and wherein the component lying against the flange is a wall of the pump housing.

12. The motor/pump unit of claim 1, wherein several holding parts are provided which extend from one of the pump cover and the flange to the other of the pump cover and the flange.

13. The motor/pump unit of claim 12, wherein the several holding parts extend from the pump cover to the flange.

14. The motor/pump unit of claim 12, wherein the several holding parts are provided in the form of screws.

15. The motor/pump unit of claim 1, wherein the holding part is a bracket-shaped spring element.

16. The motor/pump unit of claim 15, wherein the spring element has a central section held in a recess of the pump cover or of the flange, and two sections engaging behind the flange or the pump cover.

17. The motor/pump unit of claim 15, wherein the spring element has a corrugated section.

18. The motor/pump unit of claim 17, wherein the corrugated section is the central section.

19. The motor/pump unit of claim 1, wherein in the pump housing, a gear wheel set with two mating gear wheels is housed, which are each arranged on a shaft or are constructed in one piece with a shaft, the shafts being mounted in two opposite bearing rests and one of the shafts extending out of the end face of the pump housing.

* * * * *